US007665246B1

(12) United States Patent
Wagner, Jr.

(10) Patent No.: US 7,665,246 B1
(45) Date of Patent: Feb. 23, 2010

(54) DOOR AND FRAME ASSEMBLY, SYSTEM AND METHOD FOR COMMERCIAL COOLERS AND FREEZERS

(76) Inventor: William C. Wagner, Jr., 6028 Brookridge Rd., Jacksonville, FL (US) 32210

( * ) Notice: Subject to any disclaimer, the term of this patent is extended or adjusted under 35 U.S.C. 154(b) by 968 days.

(21) Appl. No.: 10/874,685

(22) Filed: Jun. 23, 2004

Related U.S. Application Data

(60) Provisional application No. 60/482,499, filed on Jun. 25, 2003.

(51) Int. Cl.
*E06B 3/00* (2006.01)
*F25B 47/00* (2006.01)

(52) U.S. Cl. ..... 49/501; 49/506; 49/DIG. 1; 62/277

(58) Field of Classification Search ..... 49/501, 49/DIG. 1, 275, 506; 62/277, 451, 453
See application file for complete search history.

(56) References Cited

U.S. PATENT DOCUMENTS 2,807,942 A * 10/1957 Dahlgren ..... 62/130
3,055,193 A * 9/1962 Smith ..... 62/440
3,379,859 A * 4/1968 Marriott ..... 219/522
4,548,049 A * 10/1985 Rajgopal ..... 62/275
5,039,826 A * 8/1991 Newland ..... 174/374
5,193,310 A * 3/1993 Kiel ..... 49/501
5,255,473 A * 10/1993 Kaspar et al. ..... 49/501
5,542,258 A * 8/1996 Shim ..... 62/80
5,737,939 A * 4/1998 Valence et al. ..... 62/441
6,037,033 A * 3/2000 Hunter ..... 428/72
6,301,913 B1 * 10/2001 Schulak et al. ..... 62/248
6,983,565 B2 * 1/2006 Berry et al. ..... 49/370

FOREIGN PATENT DOCUMENTS

GB 2096221 A * 10/1982 ..... 49/501

* cited by examiner

*Primary Examiner*—Jerry Redman
(74) *Attorney, Agent, or Firm*—Allen, Dyer, Doppelt, Milbrath & Gilchrist, P.A.

(57) ABSTRACT

A door and frame assembly useful for commercial coolers and heaters comprises a door frame having an upper horizontal member and opposing side members with an insulated door fitted in the door opening between the sides and with a discontinuous heating element extending at least along one, and preferably both, of the sides.

9 Claims, 6 Drawing Sheets

DOOR AND FRAME ASSEMBLY, SYSTEM AND METHOD FOR COMMERCIAL COOLERS AND FREEZERS

CROSS-REFERENCE TO RELATED APPLICATIONS

This application incorporates by reference and claims priority to Provisional Application Ser. No. 60/482,499 for "Door and Frame System for Commercial Coolers and Freezers," having a filing date of Jun. 25, 2003, and commonly owned with this application.

BACKGROUND OF THE INVENTION

The present invention is directed to door and frame assemblies, systems and methods which are designed specifically for installation with commercial freezers and coolers, such as those used in supermarkets and similar facilities.

DESCRIPTION OF THE PRIOR ART

A number of door and frame assemblies have been devised in the past for use with commercial freezers and coolers. By way of example, U.S. Pat. Nos. 5,161,329 and 6,240,703, both to Brown, disclose constructions useful for these purposes.

While the constructions shown in the aforementioned Brown patents solve many of the needs of such door and frame assemblies, there is a need for a more facile, low cost assembly, system and method; there is also especially a need for door and frame systems that provide heating to avoid freezing of the door to the frame, but in a dependable manner which is not damaged while the freezer or cooler is in use.

SUMMARY OF THE INVENTION

The present invention is directed to a door and frame assembly useful for commercial coolers and heaters. The frame assembly comprises a door frame having an upper horizontal member and opposing side members each of which extends from an end of the horizontal member. The upper and side members define a door opening, and the assembly includes an insulated door fitted into the door opening and pivotally mounted to one of the members so as to rotate between open and closed positions.

In accordance with the present invention, the assembly is provided with heating means along at least one of the side members, the heating means comprising an electrical heating element which is free of a continuous electrical circuit with heating means along the opposing side.

In a preferred embodiment, the assembly further includes another heating means along the opposing side, the another heating means comprising an electrical heating element which is free of a continuous electrical circuit with the heating means along the first, opposing side.

The insulating door of the present invention preferably comprises opposing molded sheets of thermoplastic material forming a void therebetween with a foam insulation in the void.

The method of the present invention contemplates the fabrication of a door frame assembly useful for commercial coolers and heaters. The method utilizes the step of providing a door frame having an upper horizontal member and opposing side members each of which extend from an end of the horizontal member, with the upper and side members defining a door opening. The method further comprises the step of fitting an insulated door pivotally mounted to one of the members so as to rotate between open and closed positions, and installing heating means along at least one of the side members, the heating means comprising an electrical heating element which is free of a continuous electrical circuit with heating means along the opposing side.

THE DRAWING

The present invention is directed to a door and frame construction, system and method which is designed to provide the benefits of prior art door and frame structures, and to also meet the further needs discussed above. The features and benefits of the door and frame construction, system and method of the present invention will be described in detail with reference to the drawing figures, in which.

DETAILED DESCRIPTION

Figure 1:
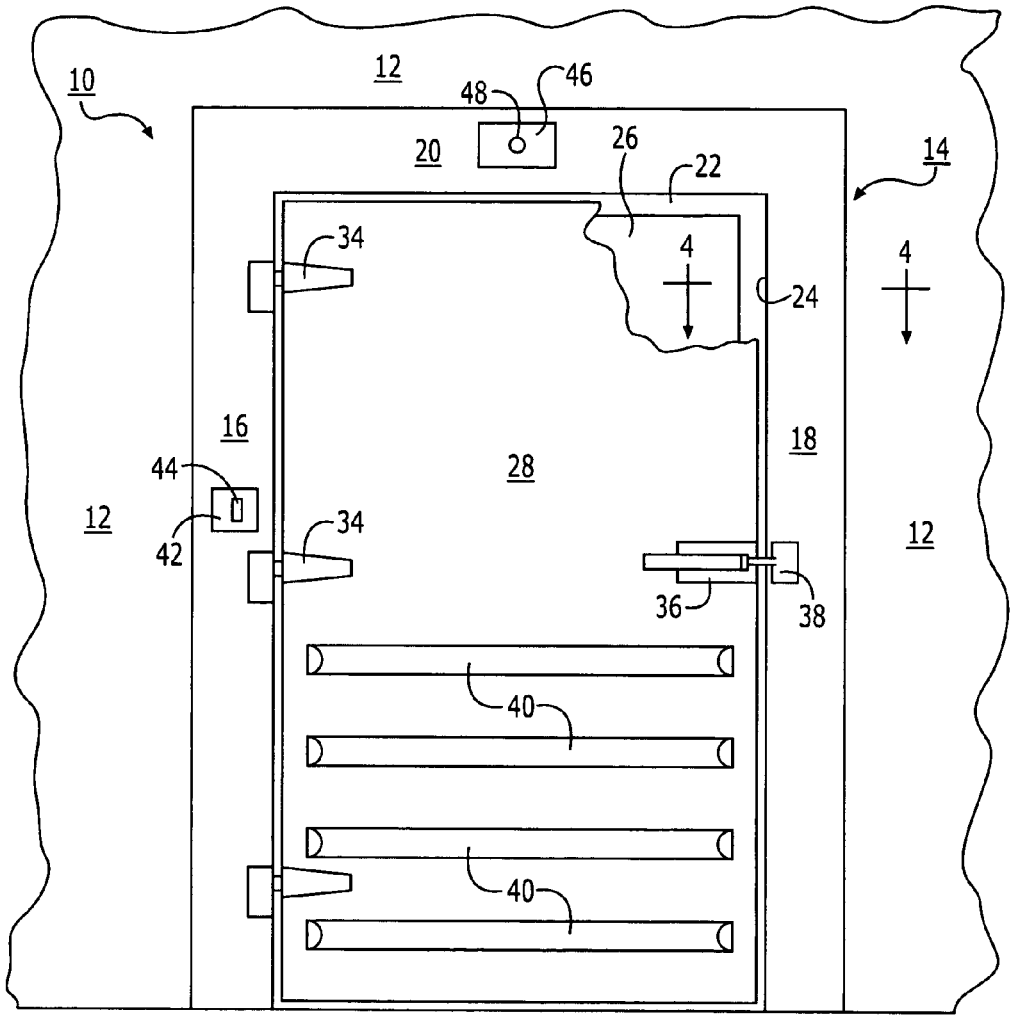
FIG. 1 is a front elevation of a door and frame construction and system in accordance with the present invention.

With continuing reference to the drawings, the door and frame assembly 10 of the present invention is designed for installation in an opening of a freezer or cooler having an outer wall 12 with the assembly 10 fitted in the opening.

In accordance with the present invention, the door and frame assembly 10 comprises a door frame 14 having left and right vertical sides 16, 18 and a horizontal member 20 between the sides 16, 18. The frame 14 is preferably molded from a suitable plastic material such as fiberglass, ABS plastic or polycarbonate, for example.

Figure 4:
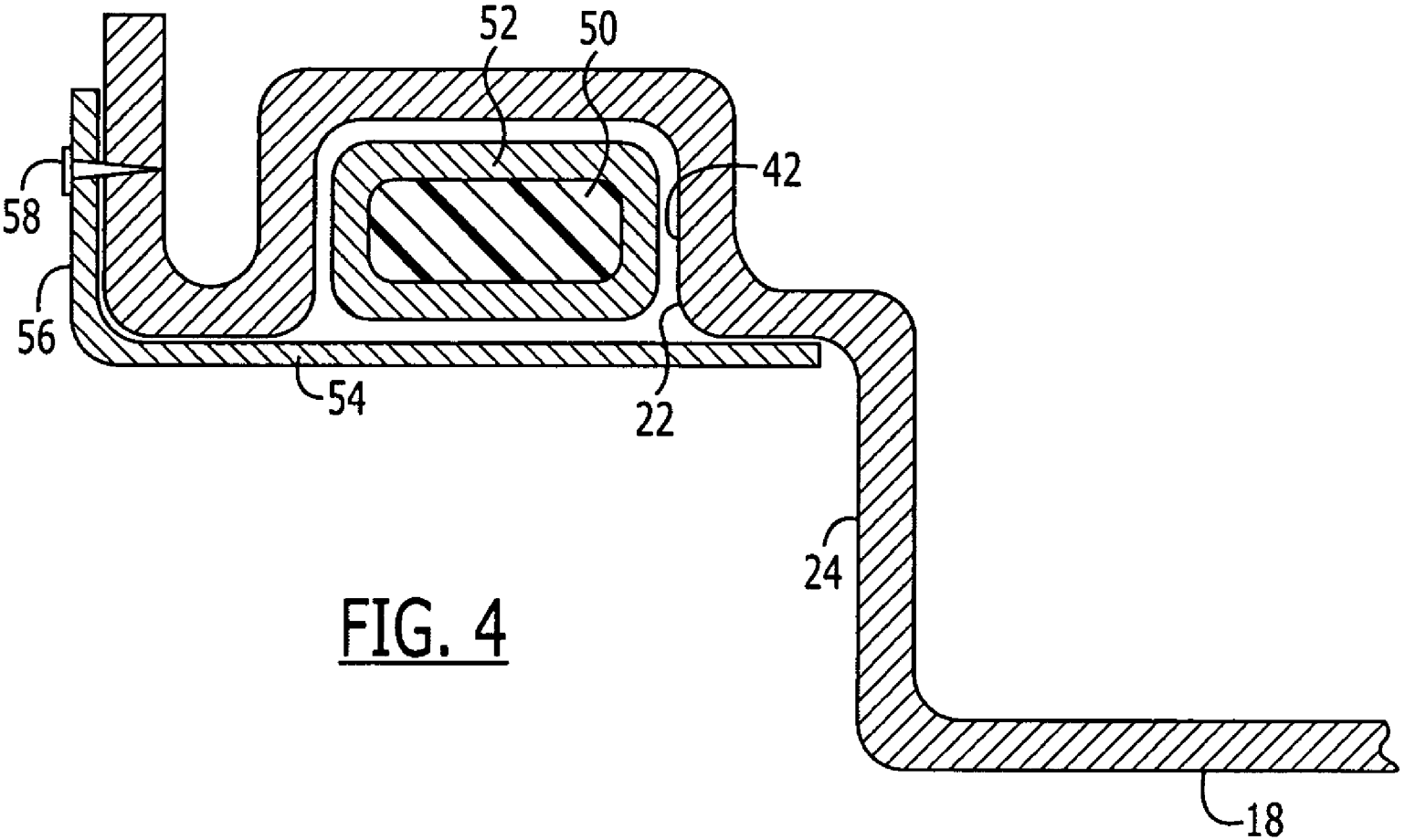
FIG. 4 is a partially cut away view along the line 4-4 of the construction of FIG. 1, illustrating a first embodiment of a heating element along an inside facing surface of the frame in FIG. 1.
Figure 5:
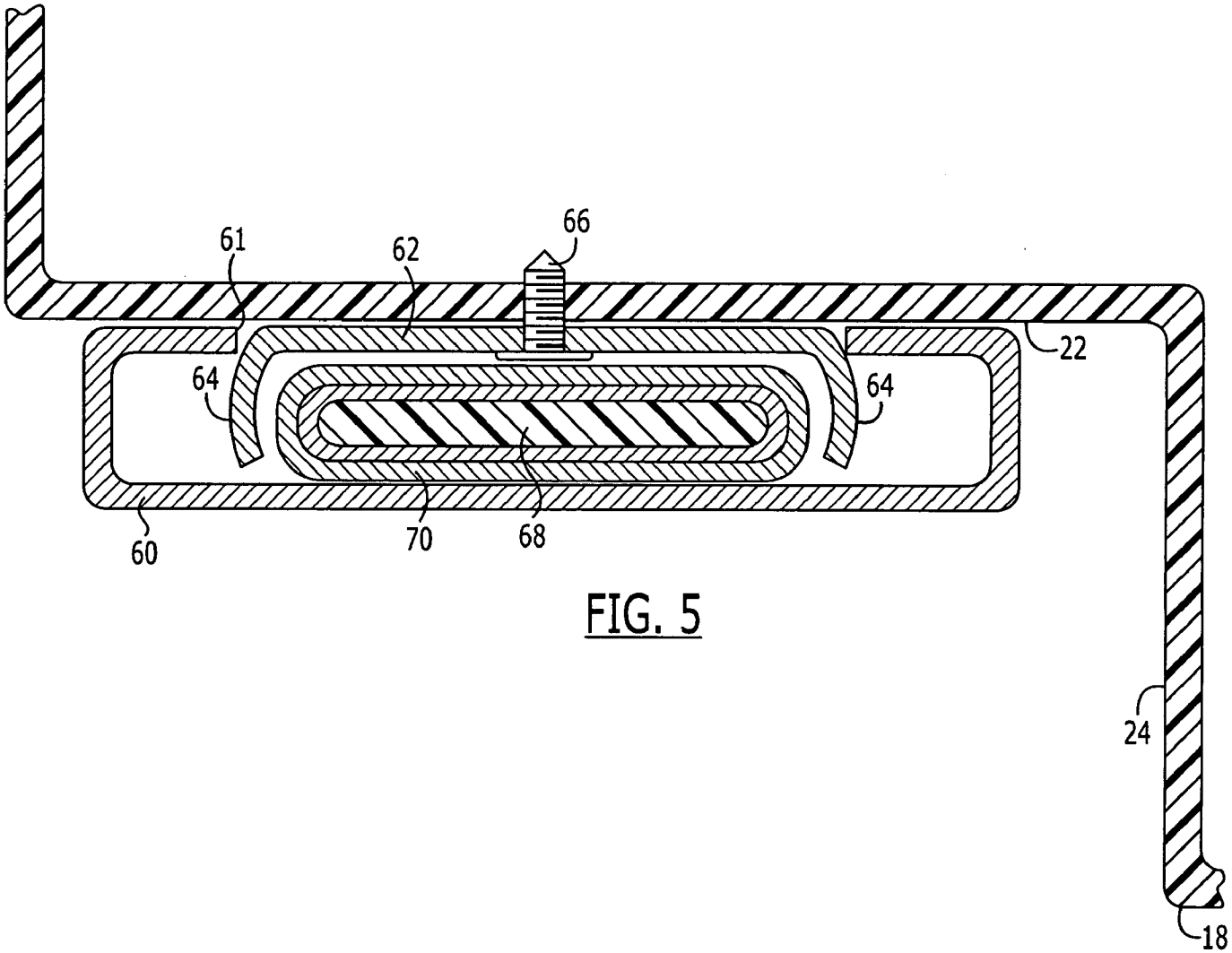
FIG. 5 is a partially cut away cross section of a second embodiment of a heating element along the inside face of the frame in FIG. 1.

The frame 14 further comprises an inner surface 22 extending parallel with but recessed from the sides and horizontal members 16, 18 and 20 by the dimension of an indented surface 24 (note FIGS. 4 and 5). A heater element, described in greater detail below in FIGS. 4 and 5, is carried along the inner surface 22 along the horizontal member 20 and the vertical sides 16, 18.

As shown in FIG. 1, the frame 14 defines a door opening 26 into which a door 28 is fitted. The door is attached to one of the vertical sides 16, 18 with hinges 34, and includes an opener handle 36 and a latch 38 mounted along one of the vertical sides opposing the hinges 34. Preferably, the door 28 is provided with plural molded bumper ribs 40 along the bottom thereof, to absorb the impact of wheeled carts or other equipment that may be inadvertently banged against the door. As shown in FIG. 1 and described in greater detail below with reference to FIG. 6, the door and frame assembly 10 also includes a switch plate 42 along one of the vertical sides 16, 18 and an electrical switch 44 extending through the switch plate 42 to permit the turning off and on of lights 43 within the cooler. Further, there is provided a cover plate 46, preferably along the horizontal member 20, and an in-line fuse 48, both associated with the electrical heating circuit.

The construction details of the door 28 will now be described with reference to FIGS. 2 and 3.

Figure 2:
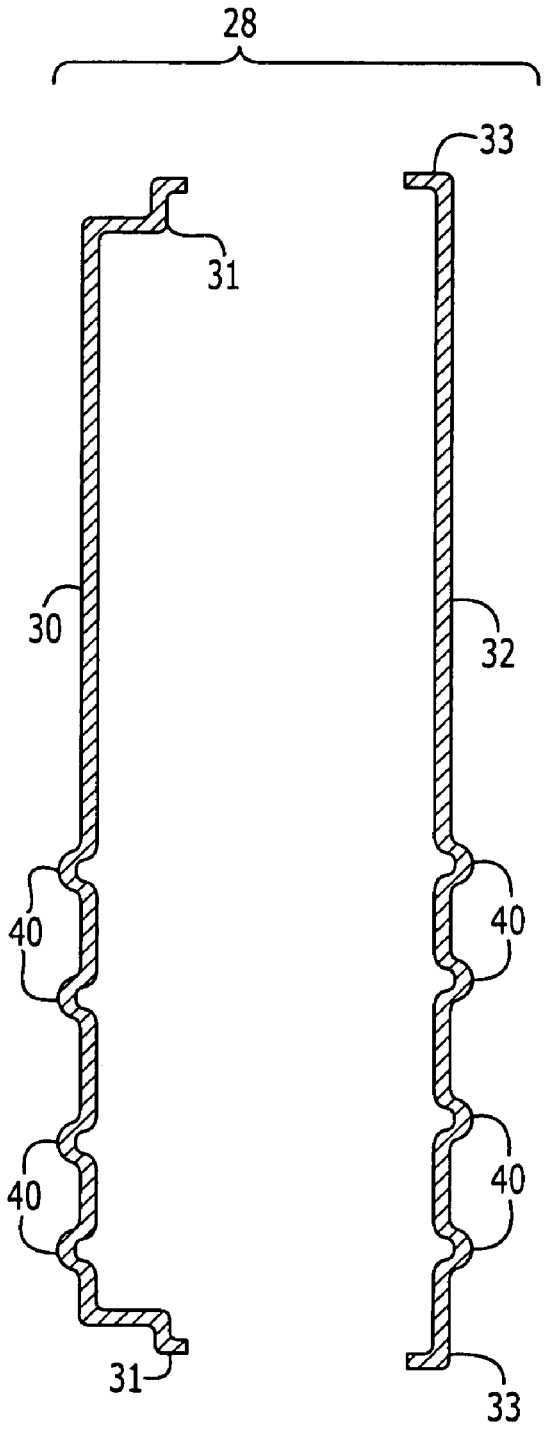
FIG. 2 is an exploded view of the shell portions of the door portion of the assembly shown in FIG. 1.

As shown in FIG. 2, the door 28 is fabricated with a rear molded shell 30 and a front molded shell 32. Each of the molded shells is provided with mating extremities 31 and 33, respectively, which permit the two shells to be bonded together by conventional means. The two shells may be molded from fiberglass, ABS plastic or polycarbonate.

Figure 3:
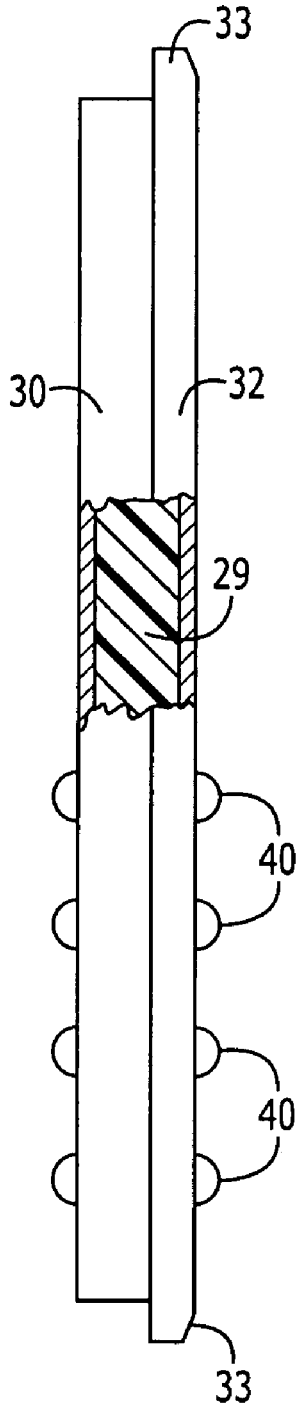
FIG. 3 is a side view, partially cut away, of the construction of the door in the assembly of FIG. 1.

Noting FIG. 3, once the rear and front shells 30, 32 are bonded together, an insulating foam 29 is injected into the space between the two shells, using a conventional delivery technique through an appropriate portal in one of the shells.

Alternate forms of the installation for heating strips are depicted in FIGS. 4 and 5. In both arrangements, the heating element is placed along the indented inner surface 22, which as shown in FIG. 4 is spaced from one of the vertical sides 16, 18 by indent surface 24. In the arrangement of FIG. 4, the frame 14 has a molded slot 42 which extends the vertical length of both sides 16, 18 and across the horizontal member 20, so that the heating element may be placed in the slot 42 as shown in FIG. 4. In this arrangement, a metal, heat conductive bracket is installed along both the vertical and horizontal dimensions of the inside detented surface 22, the bracket having a first arm 54 extending parallel with the surface 22 and a second arm 56 extending laterally from the first arm, either arm being attached to the frame 14 with fasteners 58.

The second form of the heating element is shown in FIG. 5, and utilizes a flat bracket 62 attached along the indented inside surface 22 with fasteners 66, the bracket having means for holding an outside cover 60 into engagement with the bracket; in the example of FIG. 5, the holding means comprises curled ends 64 of the bracket 62 adapted to be snapped through an opening 61 in the cover 60.

In accordance with one aspect of the present invention, the heater element used in the constructions of FIGS. 4 and 5 is a special purpose heating cable manufactured by the Raychem Corporation of Menlo Park, Calif. under the trademark FROSTEX as a pipe heating system for preventing freezing of outdoor piping. As shown in FIG. 4, a FROSTEX strip is installed into the slot 42, the strip comprising an inner heating element 50 and an outer, thermally conductive and electrically insulative shield 52. A similar arrangement is used in the construction of FIG. 5, except the FROSTEX heating system may be of a thinner configuration, including inner heating element 68 and outer, electrically insulative shell 70.

Figure 6:
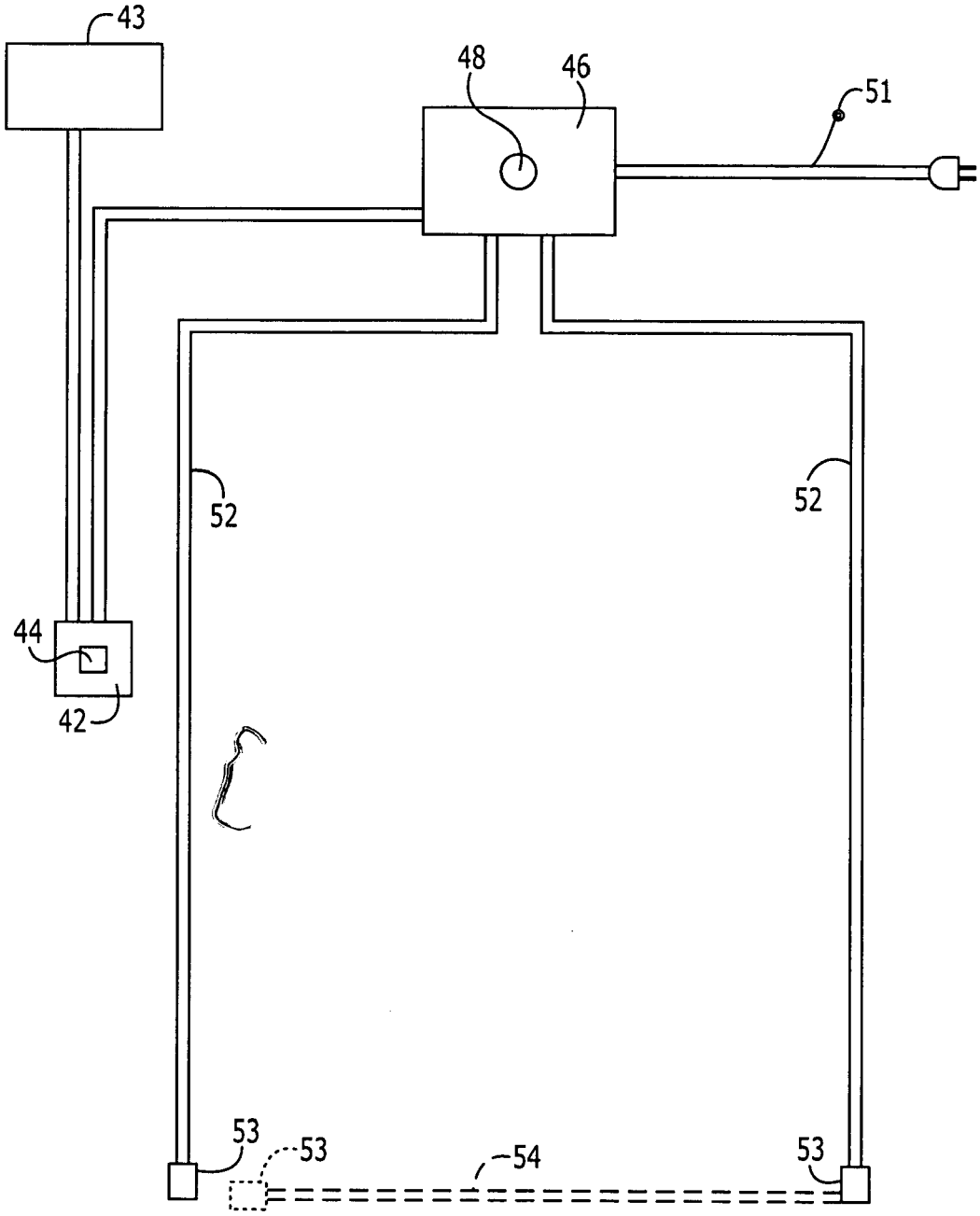
FIG. 6 is a schematic illustration of the electrical circuit providing power to the heating elements in the alternate constructions of FIGS. 4 and 5.

A principal benefit of a heating element like that provided by the FROSTEX product is illustrated in FIG. 6. In prior art heating arrangements for freezer door and frame assemblies, it was necessary to extend a wiring underneath a threshold below the door, in order to complete an electrical circuit. However, the threshold constructions are frequently damaged from heavy carts and other equipment that are banged against and dragged across the threshold, and as a result the return circuit underneath the threshold is often damaged, rendering the heater unworkable. In contrast, the utilization of the FROSTEX product in the door and frame assembly 10 of the present invention avoids the need for a return circuit underneath the threshold, because the FROSTEX product achieves heating along its length without a return circuit. Thus, turning to FIG. 6, the heating elements 52 (from FIG. 4) may extend downwardly along the indented surface 22 of the vertical side 16, 18 to a termination 53, without completing a circuit underneath a threshold of the door 28. Electrical power is received through power line 51, subject to any fault detection at fuse 48, and services both the heating circuits 52 and lights 43. It will of course be appreciated by those skilled in the art that if it is desired to heat the bottom of the door to further reduce the likelihood that the door will be stuck because of freezing, then the heating element 52 along either side 16, 18 may be extended across the threshold as shown by the dotted extension 54 in FIG. 6, without the possible interference with the remainder of the heater.

It will be appreciated by those skilled in the art that numerous modifications and improvements may be made in the door and frame assembly, system and method of the present invention without departing from the spirit and scope of this invention. For example, the heating system shown in FIGS. 4-6 and described above may be retrofitted onto existing freezer door installations.

What is claimed is:

1. A door and frame assembly useful for commercial coolers and heaters comprising:

a door frame having an upper horizontal member and first and second opposing side members each extending from an end of the upper horizontal member, the upper horizontal member and the two side members defining a door opening;

an insulated door fitted in the door opening and pivotally mounted to one of the two side members of the door frame so as to rotate between open and closed positions; and first and second heating elements each along a corresponding one of the side members, each heating element comprising an electrical heating element which is free of electrical contact with and independent of the heating element along the opposing side member and upon the failure of either the first or second heating elements the other heating element is not affected.

2. The assembly recited in claim 1 wherein the insulated door comprises:

opposing molded sheets of thermoplastic material forming a void therebetween; and a foam insulation in the void.

3. The door and frame assembly recited in claim 1 further comprising:

a lower threshold extending between the lower extremities of the first and second opposing side members and opposite and generally parallel with the upper horizontal member and below the insulated door; and wherein the first and second heating elements are installed along the respective one of first and second opposing side members without any portion of the first and second heating elements completing a circuit under the threshold.

4. The door and frame assembly recited in claim 1 further comprising:

a lower threshold extending between the lower extremities of the first and second opposing side members and opposite and generally parallel with the upper horizontal member and below the insulated door; and the lower threshold including a third heating elements that is only electrically connected with one of the first or second heating elements and is free of any electrical connection with the other of the first and second heating element.

5. A method for fabricating a door frame assembly useful for commercial coolers and heaters, comprising the steps of:

providing a door frame having an upper horizontal member and first and second opposing side members each extending from an end of the upper horizontal member, the upper horizontal member and the opposing side members defining a door opening;

fitting an insulated door in the opening and pivotally mounting the door to one of the two opposing side members of the door frame so as to be rotatable between open and closed positions; and installing first and second heating elements along each a corresponding one of the side members, each heating element comprising an electrical heating element which is free of electrical contact with and independent of the heating element along one of the opposing side member and upon the failure of either the first or second heating elements the other heating means is not affected.

6. The method recited in claim 5 further comprising the steps of:

extending a lower threshold member between the lower extremities of the first and second opposing side members opposite and generally parallel with the upper horizontal member and below the insulated door; and installing the first and second heating elements along the corresponding side member without any portion of the first or second heating means completing a circuit under the threshold.

7. The method recited in claim 6 further comprising the step of installing the heating elements so that no portion of the first or second heating elements extends under or through the threshold.

8. A method for fabricating a door assembly useful for commercial coolers and heaters, comprising the steps of:

providing a door frame having an upper horizontal member and first and second opposing side members each extending from an end of the upper horizontal member, the upper horizontal member and the opposing side members defining a door opening;

fitting an insulated door in the opening and pivotally mounting the door to one of the two opposing side members of the door frame so as to be rotatable between open and closed positions;

extending a lower threshold member between the lower extremities of the first and second opposing side members opposite and generally parallel with the upper horizontal member and below the insulated door; and installing first and second heating elements along each a corresponding one of the side members, each heating element comprising an electrical heating element which is free of electrical contact with and independent of the heating element along one of the opposing side member and upon the failure of either the first or second heating elements the other heating element is not adversely affected.

9. The method recited in claim 8 further comprising the step of installing the heating circuit means so that no portion of the heating circuit means extends under or through the threshold.

* * * * *